US005127891A

United States Patent [19]

Winston

[11] Patent Number: 5,127,891

[45] Date of Patent: Jul. 7, 1992

[54] WRIST EXERCISE DEVICE

[76] Inventor: Edith Winston, 135 Hazelwood Dr., Jericho, N.Y. 11753

[21] Appl. No.: 615,053

[22] Filed: Nov. 19, 1990

[51] Int. Cl.[5] ..... A63B 21/00

[52] U.S. Cl. ..... 482/50; 482/105

[58] Field of Search ..... 272/67, 71, 96, 119, 272/143; 2/16, 102, 162, 170, 311, 312

[56] References Cited

U.S. PATENT DOCUMENTS

| | | | |
|---|---|---|---|
| 3,278,184 | 10/1966 | Rosenbaum | 272/96 X |
| 3,306,610 | 2/1967 | Biggs, Jr. et al. | 272/119 |
| 3,334,898 | 8/1967 | McCrory et al. | 272/96 X |
| 3,924,851 | 12/1975 | Winston | 272/119 X |
| 4,241,459 | 12/1980 | Quayle | 2/102 |
| 4,637,075 | 1/1987 | Ingrisano et al. | 2/94 |
| 4,923,418 | 5/1990 | Hoffman | 272/71 X |

FOREIGN PATENT DOCUMENTS

| | | | |
|---|---|---|---|
| 1568081 | 5/1990 | United Kingdom | 272/119 |

*Primary Examiner*—John J. Wilson
*Assistant Examiner*—L. Thomas

[57] ABSTRACT

An exercise device worn as a wrist band having provision for exercise weights in a compartment formed between front and rear panels stitched to each other along opposite side and bottom edges, and having velcro strips along confronting upper edges serving as a closure for the weights' compartment and completing the attachment to each other of the front and rear panels.

1 Claim, 3 Drawing Sheets

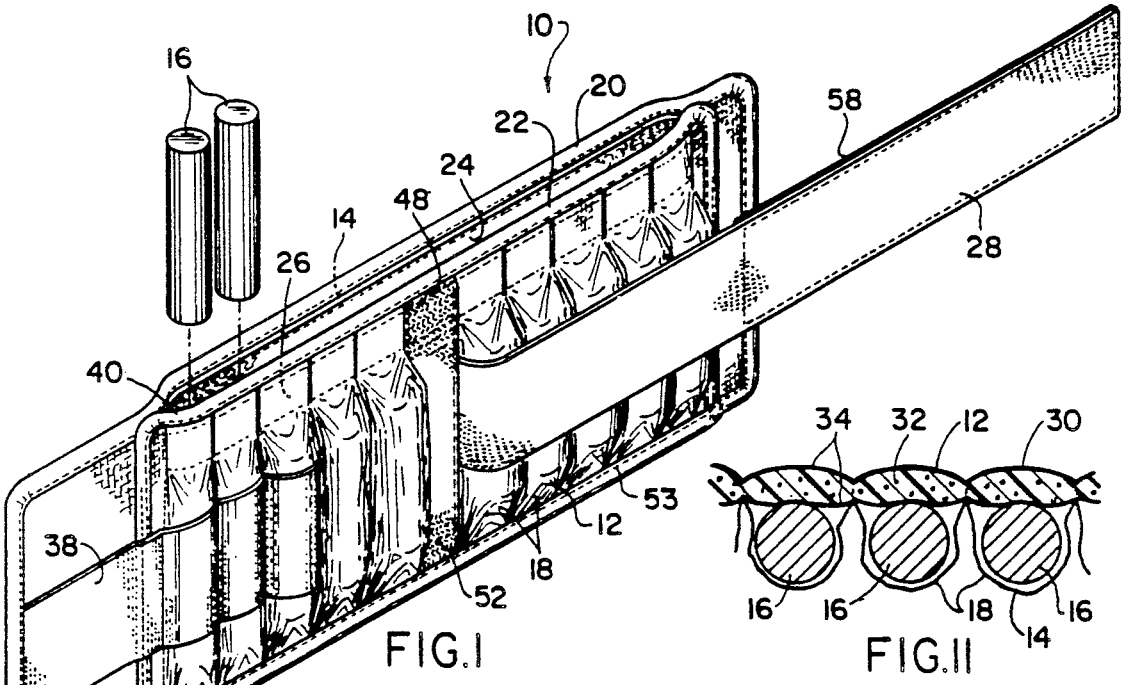
FIG.1
FIG.11
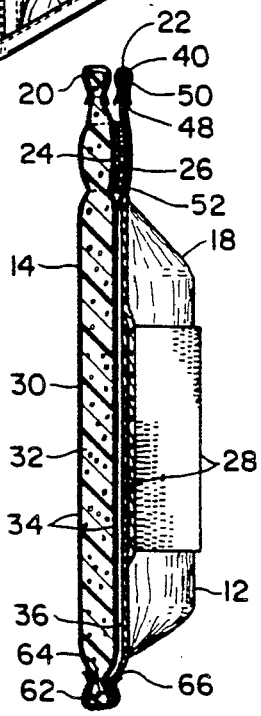
FIG.9
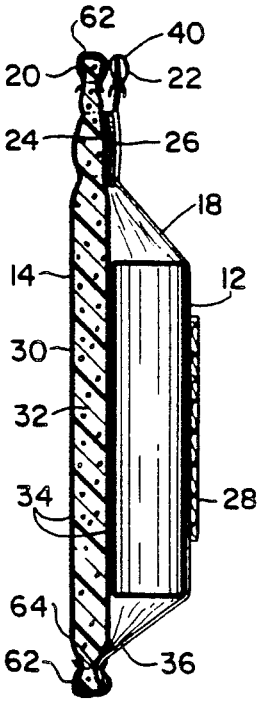
FIG.10
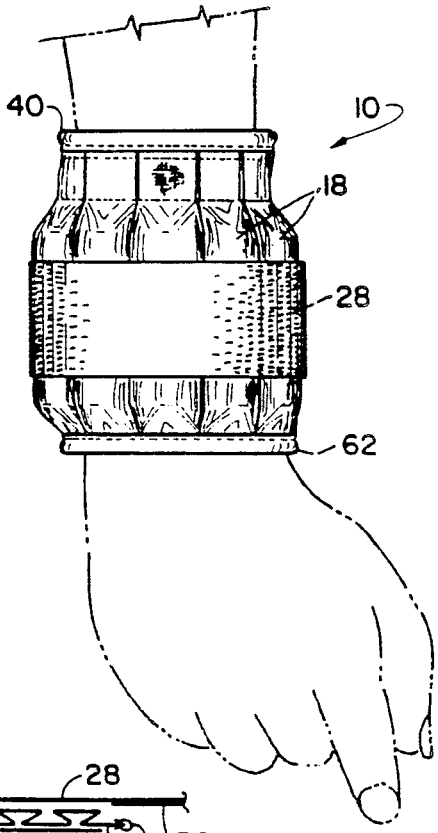
FIG.2
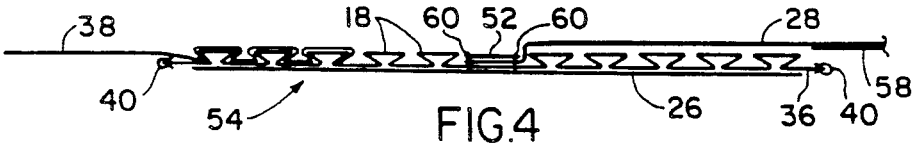
FIG.4

10
9
11
12
14
16
18
20
22
24
26
28
30
38
40
48
52
53
56
58
60
62
64
66

WRIST EXERCISE DEVICE

The present invention relates generally to exercise devices of the type worn in wrapped relation around the wrist of the exerciser and prepared with a select number of weights, and more particularly to improvements for confining the weights against inadvertent release from their storage compartments in the body of the exercise device during an exercise routine and despite the exercising movements.

EXAMPLE OF THE PRIOR ART

It is already well known, as exemplified by the prior U.S. Pat. No. 3,924,851 issued on Dec. 9, 1975 to Herbert Winston, that exercising versatility in a wrist-worn exercise device or band can result from providing compartments for selectively inserting or removing weights to correspondingly increase or reduce the physical effort required of the exerciser in performing the exercise routine. Care, however, must be exercised in preventing the inadvertent release of the weights being used in the band during the movements of the exercise routine. In the Winston U.S. Pat. No. 3,924,851, a flap is used in folded relation over the openings of the weight-receiving compartments and inserted in an interposed position between the band and the wrist to achieve this result. While the use of the closure flap as noted obviates inadvertent release of the weights, it requires removal of the band in order to make an adjustment in the number of the weights.

Broadly, it is an object of the present invention to overcome the foregoing and other shortcomings of the prior art. More particularly, it is an object to securely contain the exercise weights, while permitting ready access, preparatory. to adjusting the number, to the weights, and specifically enabling this weight adjustment without removal of the exercise band.

In accordance with the present invention, the weights in individual compartments are interposed between front and rear body panels which are firmly attached to each other by stitching applied to confronting opposite side and bottom edges. The attachment of the panels to each other is completed by cooperating hook and loop strips such as the type offered under the VELCRO trademark along the remaining upper confronting panel edges and additionally serve as an easily opened and closed closure providing ready access to the weights-receiving compartments for adjusting the number of weights being used, without having to remove the exercise band to make the weights adjustment.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of the within inventive wrist exercise device showing how weights are added or removed preparatory to the exercising use thereof;

FIG. 2 is a perspective view of the device in position on a user's wrist;

FIG. 4 is a sectional view taken along line 4—4 of FIG. 3;

Figures 5, 6, 7, 8:
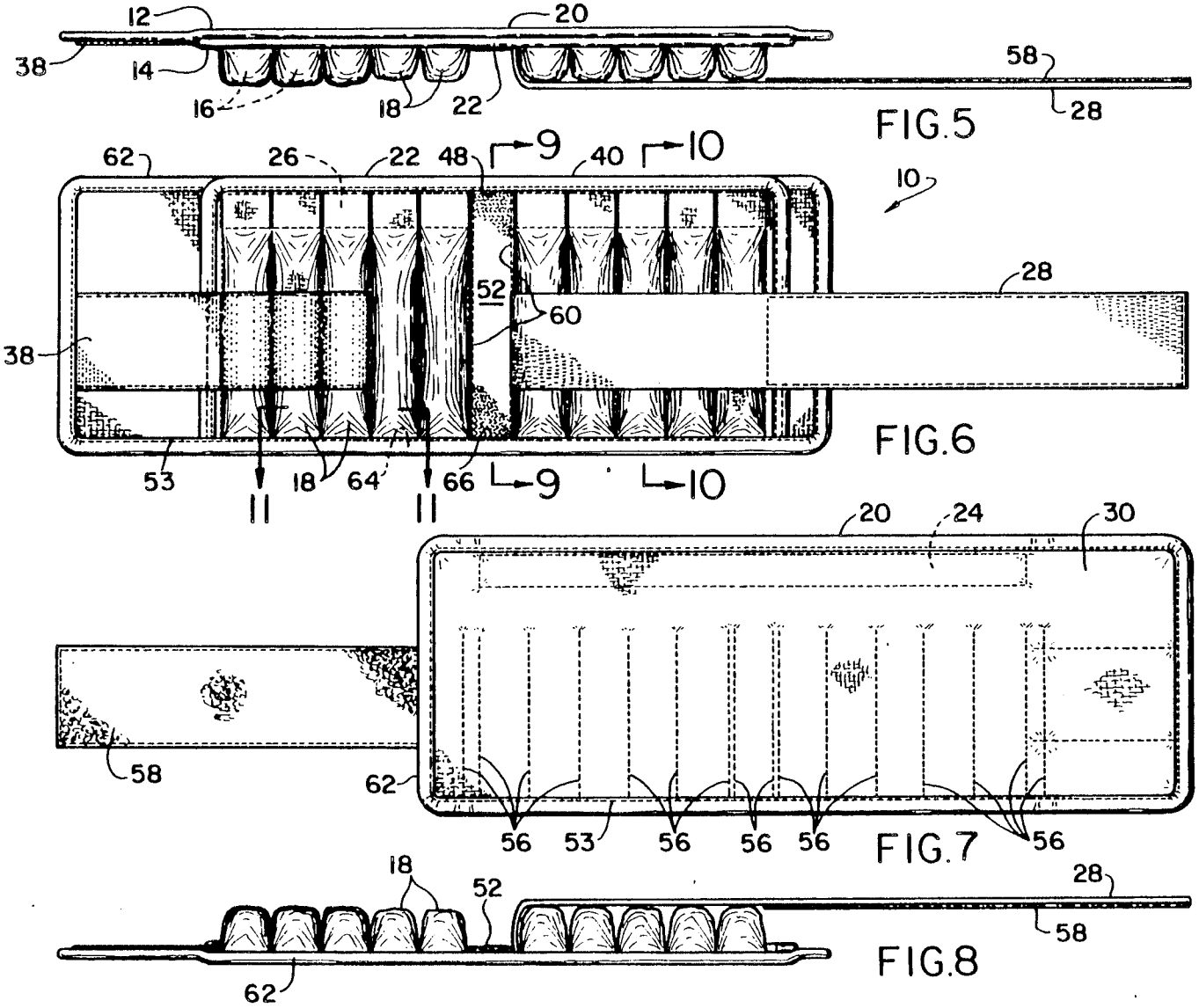
FIG. 5 is a plan view of the device.
FIG. 6 is a front elevational view.
FIG. 7 is a rear elevational view.
FIG. 8 is a bottom view.

FIGS. 9 and 10 are enlarged scale sectional views respectively taken along lines 9—9 and 10—10 of FIG. 6; and FIG. 11 is a partial sectional view taken along lines 11—11 of FIG. 6.

Device 10, as functionally shown in FIGS. 1 and 2 has a weight pocket side, i.e. outer side 12, and a padded side, i.e. inner side 14. Weights 16 can be added or removed as the user desires, by inserting into or removing the weights from individual pockets 18 provided along the inner surface of side 12. Weights 16 preferably are $\frac{1}{2}''$ diameter, about $25\frac{1}{4}''$ long and weigh 2 ounces each. Access to individual weight-receiving pockets 18 is through an opening between separating edges 20, 22 which when not separated are adapted to be held together by a cooperating VELCRO loop strip 24 and VELCRO hook strip 26. When device 10 is prepared and ready for use in an exercise routine, the user utilizes web strap 28 to secure device 10 about his or her wrist as shown in FIG. 2.

Figure 3:
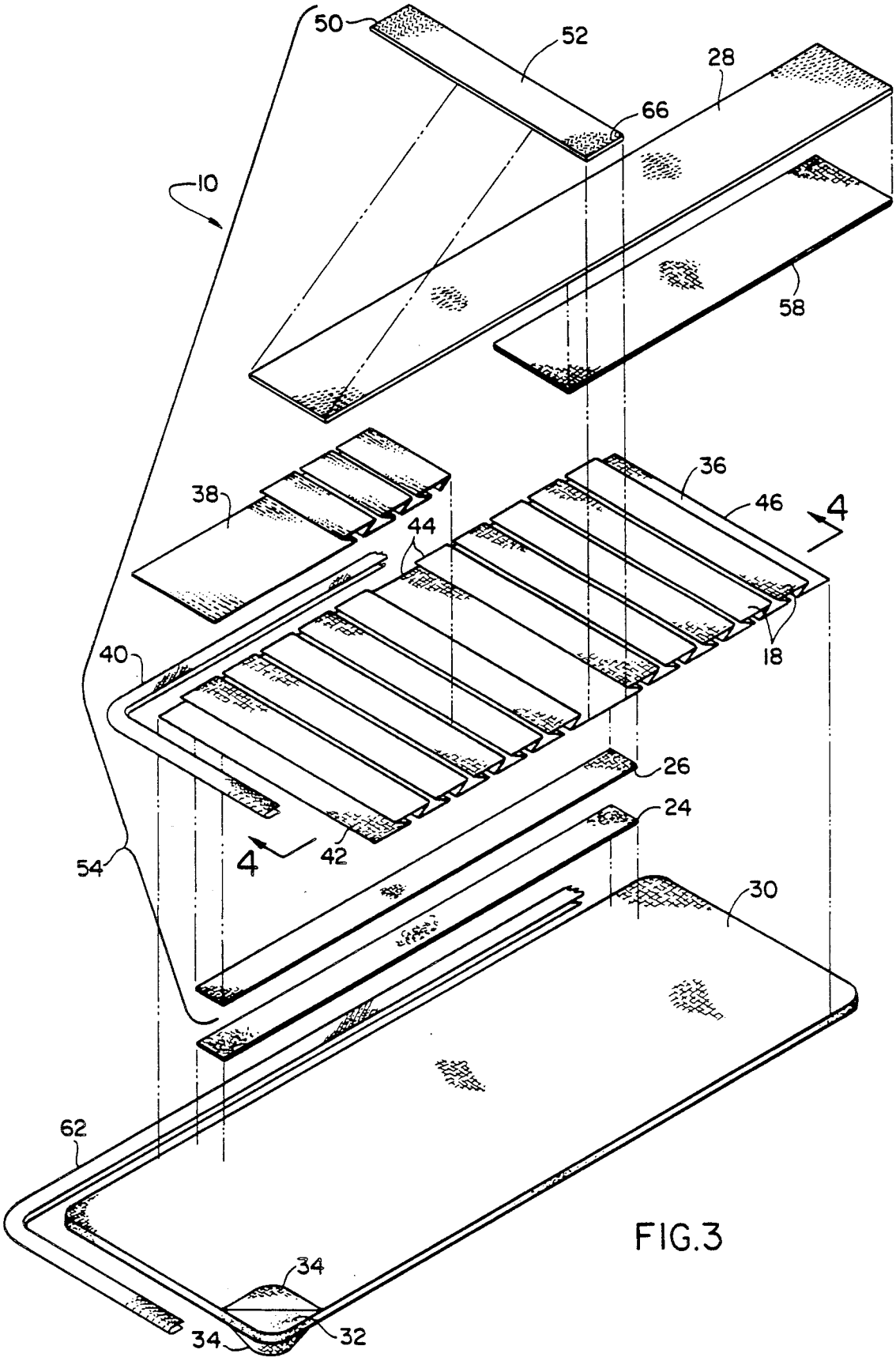
FIG. 3 is an unassembled perspective view of the components of the device.

Device 10 is fabricated of the components best seen in FIG. 3. rear body panel 30, approximately $45\frac{1}{4}'' \times 115\frac{3}{4}''$, is cut from laminated stock that is made of a layer of foam plastic 32 that has a fabric layer 34 adhered to each face. The VELCRO hook closure strip 24 is stitched along an upper edge on the lip 20 of panel 30. A second sub-assembly is prepared by sewing VELCRO loop strip 58 to strap 28. Pockets 18 are formed starting with a fabric strip 36 that is $45\frac{1}{4}'' \times 24''$ and of heavy denier yarn. The inboard end of strap 28 is appropriately located at the center of strip 36 and secured thereon with reinforcing strip 52 along a pair of vertical seams 60. VELCRO loop strip 58 on strap 28 and hook strip 38 define a pair of strap means which are used to encircle the wrist, as shown in FIG. 2, in an overlapping relation such that the diameter of a created loop exerts an inwardly-directed force through the weight-receiving compartments, thus assisting with the maintenance of the weights in the compartments. Alternatively, the strap means pair may be defined by a pair of extending flaps in the nature of flap 28. Strip 36 is then sewn to VELCRO hook strip 38 and folded as in a pleated or undulated fashion as best illustrated schematically in FIG. 4. While strip 36 is in its folded condition, a first piping strip 40 is sewn along the side edge 42, top edge 44 and opposite side edge 46. During the sewing of piping strip 40 along top edge 44, an upper end 50 of reinforcing strip 52 is included within the piping seam, as at 48. The VELCRO loop closure strip 26 that cooperates with VELCRO hook strip 24 on the rear panel 30 is sewn on the folded pocket strip 36. The assembly of front panel 54 to rear panel 30 is provided with sixteen vertically oriented spaced seams 56, six pairs of which, as best seen in FIG. 7, are used to define the individual weight-receiving compartments 18 between adjacent seams 56. Assembly 54 is further reinforcingly stitched to panel 30 by the remaining vertical seams 56, including reinforcing the attachment of reinforcing strip 52 and strap 28 which already has been stitched in place with seams 60.

A second piping strip 62 is next sewn about the entire periphery of panel 30 by a seam 53, excluding, however, upper edge 22 of front panel 54 so that there remains between the confronting edges 20 and 22 of respectively rear panel 30 and front panel 54 an opening into a weight compartment between rear panel 30 and the inner or facing surface of front panel 54 in which compartment are located the individual weight-receiving compartments 18. Seam 53 and piping 62 are arranged when they are applied to include the lower end 66 of the reinforcing strip 52 and the bottom edge 64 of the front panel assembly 54.

When in use the device 10 is loaded with a predetermined number of weights 16 according to the exercise routine. By separating the edges 20 and 22 the user can easily remove or replace weights 16 very quickly and close the device 10 by pressing VELCRO closure strips 24 and 26 against each other. The VELCRO closure 24, 26 for the weights 16 also supplements the attaching seams 54 in completing the attachment to each other of the rear and front panels 30 and 54.

While the construction of the exercise device for practicing the within inventive containment of the exercise weights herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved wrist exercise device comprising a padded rear body panel of rectangular shape having elongated upper and lower edges and opposite side edges, a front panel of corresponding rectangular shape having inner and outer surfaces and adapted to be sewn along opposite sides and a lower edge with said inner surface thereof in facing relation to and in superposed position over said rear body panel so as to bound a weight compartment between said inner surface thereof and said rear body panel, a fabric strip attached by spaced seams in undulating relation to said front body panel inner surface defining individual weight-receiving compartments between adjacent seams, a pair of cooperating strap means each having complementary hook and loop strips attached thereto to permit the engagement thereof in an overlapping closed loop relation about said device so as to provide an inwardly-directed force through said weight-retaining compartments to retain said weights therein, said strap means further being attached to said outer surface of said front body panel and adapted to hold said exercise device in encircling relation about a user's wrist, and cooperating hook and loop strips attached along the upper edge of said rear body panel and along a confronting edge of said front body panel inner surface, whereby said hook and loop strips are adapted to permit the attachment of said front and rear body panels along said upper edge of said rear body panel and said confronting edge of said front body panel while simultaneously serving as a closure for said weight-receiving compartments.

* * * * *